United States Patent [19]

White et al.

[11] 4,188,884

[45] Feb. 19, 1980

[54] WATER REACTIVE UNDERWATER WARHEAD

[75] Inventors: William D. White, Pasadena; James H. Green, Sierra Madre; Neri E. Cornford, Pasadena, all of Calif.

[73] Assignee: The United States of America as represented by the Secretary of the Navy, Washington, D.C.

[21] Appl. No.: 385,561

[22] Filed: Jul. 27, 1964

[51] Int. Cl.[2] ..... F42B 15/20

[52] U.S. Cl. ..... 102/54; 102/7; 114/20 R

[58] Field of Search ..... 102/54, 7, 10, 16, 17, 102/18; 114/20

[56] References Cited

U.S. PATENT DOCUMENTS 3,109,373 11/1963 Saffer ..... 102/54

*Primary Examiner*—Harold J. Tudor

*Attorney, Agent, or Firm*—Q. B. Warner; G. J. Rubens; V. C. Muller

EXEMPLARY CLAIM

1. Apparatus for inflicting explosive damage upon an underwater object, comprising;

(a) an encapsulated charge of a first material which is highly reactive with water, said first charge being for explosively reacting with the water to produce a gas bubble which sequentially expands to a predetermined peak size and then contracts, (b) explosive means for bursting the encapsulated charge in a manner in which the bursted particles of said first materials are dispersed in directions symmetrically outward from the center of the charge to cause the bursted particles of said bursted material to penetrate the ambient water with a symmetric and uniformly dense pattern of penetration, and thereby obtain effective and complete explosive reaction between said first material and the water medium and produce said peak size of bubble, and (c) means for initiating said explosive means for bursting the encapsulated charge when said charge is sufficiently close to the object that a material portion of the bubble front is in contact with the surface of the object when the bubble reaches its peak size, whereby upon contraction of the gas bubble a re-entrant jet of ambient water enters the bubble in a direction normal to the surface of the object to exert a punch-like force thereagainst.

1 Claim, 7 Drawing Figures

WATER REACTIVE UNDERWATER WARHEAD

The invention described herein may be manufactured and used by or for the Government of the United States of America for governmental purposes without the payment of any royalties thereon or therefor.

This invention relates to improvements in torpedo warheads and other explosive devices for producing an underwater explosion. The invention also relates to a novel method and apparatus for employing a material which is highly reactive with water to inflict damage upon a submerged object.

Prior art torpedo warheads contain explosive charges which are homogenous admixtures of a high explosive and a material which is highly reactive with water, such as powdered forms of the low atomic weight metals. The resultant explosive reaction occurs in two phases. In the first phase the high explosive detonates producing a shock wave and producing an explosive force which disperses the water reactive material. In the second phase, the dispersed water reactive material reacts with water. These phases occur with such suddenness that they are essentially indistinguishable except with special instrumentation. Large amounts of hydrogen gas are released by this reaction with water, producing a gas bubble with explosive suddenness. There are two advantages to the inclusion of the water reactant material in the warhead charge. First, by setting the fusing system to explode the warhead within a few feet of the target the gas bubble generated by the water reaction has been found to be highly effective in inflicting damage upon targets. Secondly, the reaction between the water reactive material and the water inherently provides higher energy of reaction per unit weight of warhead, since one of the reactants in the metal and water reaction is taken from the environment.

Prior art approaches to developing more effective warheads have chiefly consisted of increasing the proportion of powdered metals mixed with high explosive in formulating the homogenous admixtures of explosive and powdered metal in an attempt to produce larger bubbles and provide higher unit weight energy of reaction. However, it has been found that the maximum limit of powdered metal in such homogenous mixtures is approximately 35% of the total weight. Attempts to increase the proportion of powdered metal above 35% have resulted in prohibitive difficulties in processing, degradation in reliability of detonation, and a degradation in total damage inflicting capacity as the result of a disproportionate decrease in shock wave energy.

Recognizing the foregoing, and seeking to achieve results not heretofore achieved by the prior art and other unsuccessful attempts, the objectives of the present invention include provision of:

(1) An improved explosive device for producing underwater explosions, which generates materially larger gas bubbles and which obtains a materially greater proportion of its energy of reaction from the ambient water than heretofore generated and obtained by prior art devices of equivalent weight.

(2) An improved explosive device in accordance with the preceding objective which may be reliably detonated.

(3) An improved explosive device in accordance with the preceding objective which is easy to fabricate.

(4) An improved explosive device for producing underwater explosions, which make it possible for the portion of energy of the explosive reaction transformed into the gas bubble to be more effectively concentrated to inflict greater damage upon a submerged object.

(5) A novel method and apparatus for employing a material which is highly reactive with water to inflict damage upon a submerged object.

Other objects and many of the attendant advantages of this invention will be readily appreciated as the same becomes better understood by reference to the following detailed description when considered in connection with the accompanying drawings wherein.

Figure 2:
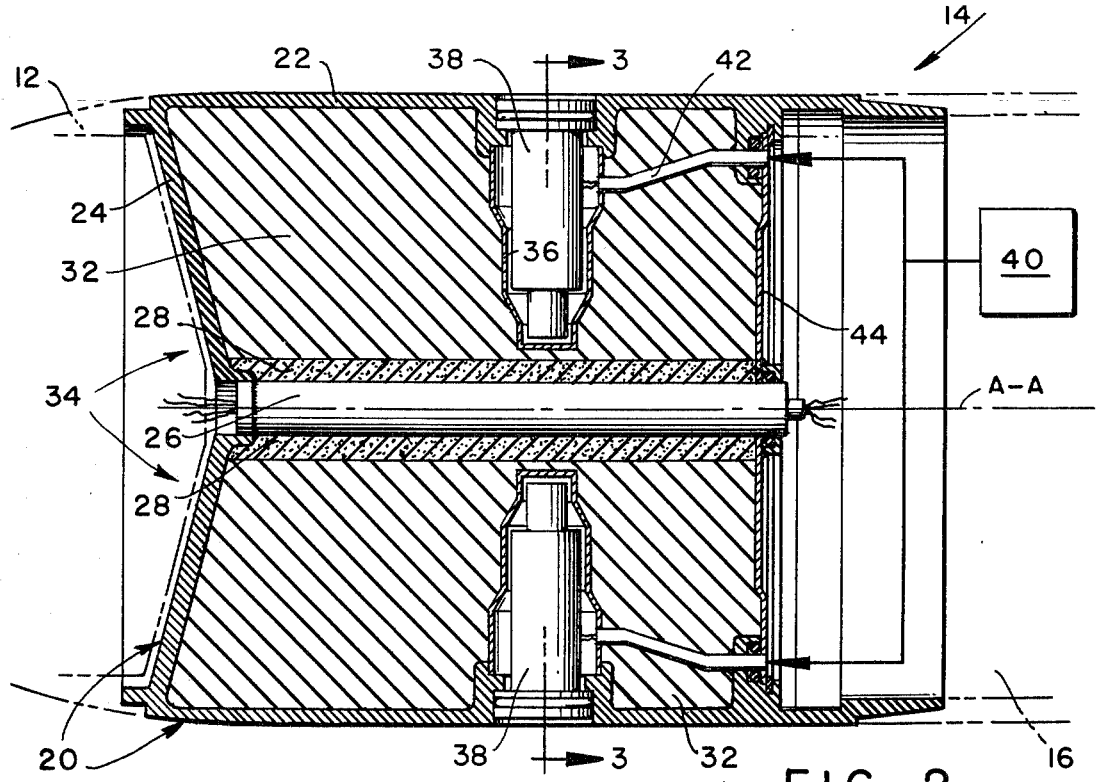
FIG. 2 is an enlarged central longitudinal section of the warhead of the torpedo of FIG. 1, taken along lines 2—2, FIG. 1.

FIGS. 4A, 4B, 4C and 4D diagrammatically show sequential shapes of a gas bubble generated by explosion of the warhead of FIG. 2 adjacent the hull of a submarine.

Figure 1:
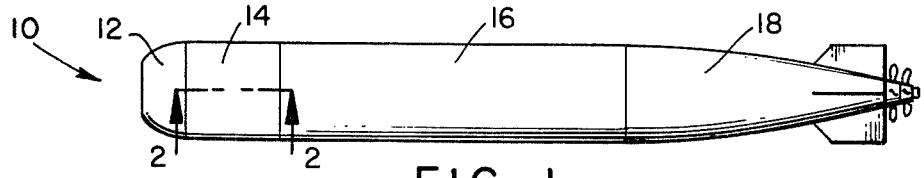
FIG. 1 is a top view of a torpedo containing a warhead in accordance with the present invention.

Referring to the drawing, and in particular to FIG. 1, a torpedo 10 is of the type employed in attacking a submerged submarine and having a self-contained acoustic guidance system (not shown) which steers the torpedo at the submarine. Torpedo 10 is conventionally formed from separable sections consisting of a nose section 12, a warhead section 14, a mid-body section 16, and a tail section 18.

Figure 3:
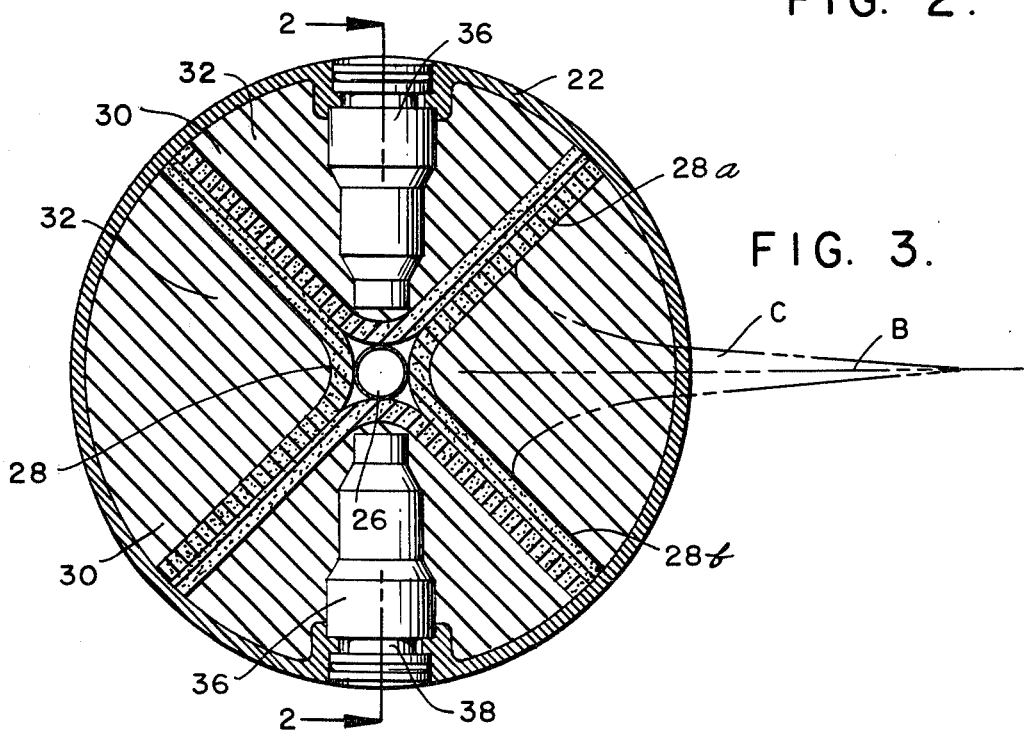
FIG. 3 is a section taken along line 3—3, FIG. 2.

Referring now to FIGS. 2 and 3, warhead section 14 comprises a unitary cast aluminum housing 20, which forms the hull 22 and a transverse wall 24 at the front end of the warhead section. A central tube 26 extends throughout the length of warhead section 14 and serves as a conduit for various electrical connections between nose section 12 and mid-body section 16.

Four trough-shaped high explosive elements 28 are disposed in the annular space between the central tube and the hull. Each element 28 is a unitary elongated extrusion of a high explosive material, such as Pentaerythritol Tetranitrate (PETN). In shape, each element 28 resembles a trough, consisting of a pair of elongated rectangular lateral wing portions **28*a*, 28*b*, which are disposed at 90° angles to one another and joined together at adjacent elongated sides by a rounded corner. Elements 28 are disposed in quadrature relationship about torpedo axis A—A with the outer surface of each lateral wing portion abutting the like surface of the adjacent element. This arrangement of the four elements divides the annular space between the central tube and hull into four cells or cavities 30, with each cavity shaped as an elongated quarter segment of a cylinder. A filler 32 of a material which is highly reactive with water, such as lithium or other low atomic weight metal, is cast into each cavity 30. The high explosive elements 28 and the water reactive fillers 32 together form an explosive warhead unit 34**.

The high explosive elements 28 and the fillers 32 are constructed and arranged as described for the following reasons. Each cavity 30 formed by the high explosive has a wedge-shaped cross section as best shown in FIG. 3. In accordance with well known principles when the high explosive material forming such a wedge-shaped cavity is exploded a shaped charge effect will occur concentrating the explosive force as a jet along the direction B bisecting the wedge-shaped cross section of the cavity. Since the wedge shaped cross section extends along the length of the warhead section, each trough-like element 28 produces a shaped charge concentration of explosive force which linearly extends along the full length of warhead section, and has a cross section shaped as a jet C, (phantom lines, FIG. 3), aligned about direction B. The detonation of the four high explosive elements 28 is essentially instantaneous and four corresponding linearly extending shaped charge effects occur simultaneously and with symmetry about axis A—A. Preferably, a low atomic weight metal that has a low melting point, such as lithium, is employed for the filler 32, and a sufficient amount of high explosive material is employed in high explosive elements 28 to provide the necessary initial heat of reaction to cause melting of the filler during its dispersion by the shaped charge effects. This results in the filler being dispersed into the ambient water as liquified particles. The ratio of high explosive to water reactive metal needed to cause melting of the filler during its dispersion may be predetermined by conventional chemical process calculations. It has been found that it is sufficient that the initial heat of reaction melts a fraction of the filler material, in the order of one-half or less, and that the reaction between the filler and the water will effect complete melting of the filler. In a preferred embodiment in which melting of the filler takes place the high explosive elements 28 were of PETN and constituted 20% of the total weight of warhead unit 34, and the water reactive fillers 32 were of lithium and constituted the remaining 80% of the weight. The aluminum hull 22 serves to encapsulate the water reactive fillers 32 and thereby seal them from contact with water prior to firing the warhead. Hull 22 merely disintegrates under the explosive force of the warhead unit 34.

Exploder housings 36 project into warhead section 14 at the top and bottom of the hull, forming cavities which are accessible from the experior of the hull to removably receive exploder mechanism 38. These mechanisms 38, which are conventional, comprise an electrically initiated explosive train including a booster charge and a detonator charge. The detonator charge is disposed at the inner ends of the exploder mechanisms, and the construction and arrangement is such that the inner ends of the exploder mechanisms practically abut an internal corner of an adjacent high explosive element 28 to insure efficient coupling of the explosive force from detonator charge to the high explosive elements 28. The two exploder mechanisms 38 operate redundantly to further insure reliable detonation. The electrical firing impulse to initiate the exploders comes from a magnetic influence type proximity fuse device 40 disposed in mid-body section 16. Fuse device 40 is set to generate the firing impulse when the torpedo is a predetermined distance, within several feet of the hull of a submarine. Fuse 40, which is conventional, operates on the principle of sensing the proximate presence of a submarine hull by the influence of the metallic hull upon a highly sensitive magnetic sensing circuit which is part of the fuse device. The firing impulse signal is transmitted from fusing device 40 to the exploder mechanisms via electric connections which extend through conduit tubes 42 communicating between the exploder housing cavities and the rear end of the warhead section. The rear end of warhead section 14 is closed by a transverse wall 44, and suitable O-rings and gaskets are provided to seal the interior of the warhead against possible water entry. Exploder housings 36 and conduit tubes 42 are installed prior to casting the water reactive fillers 32 in place.

Figure 4A:
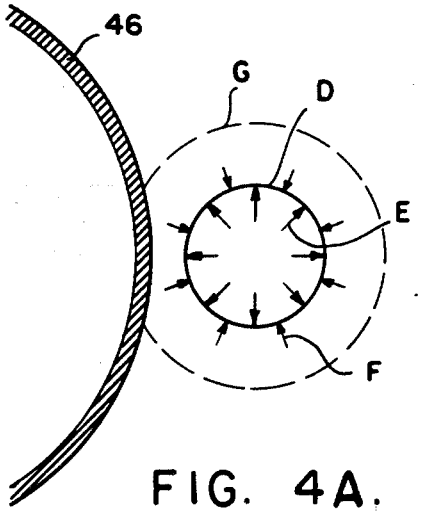
Figure 4C:
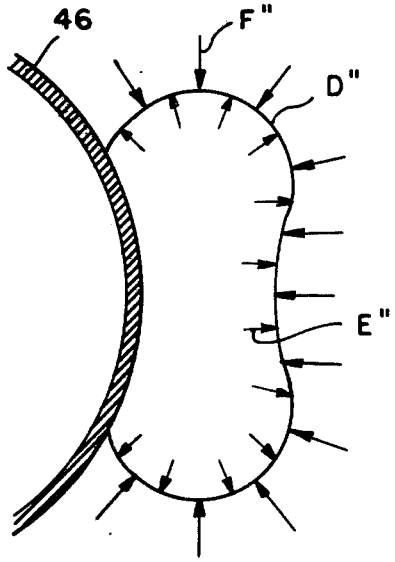
Figure 4B:
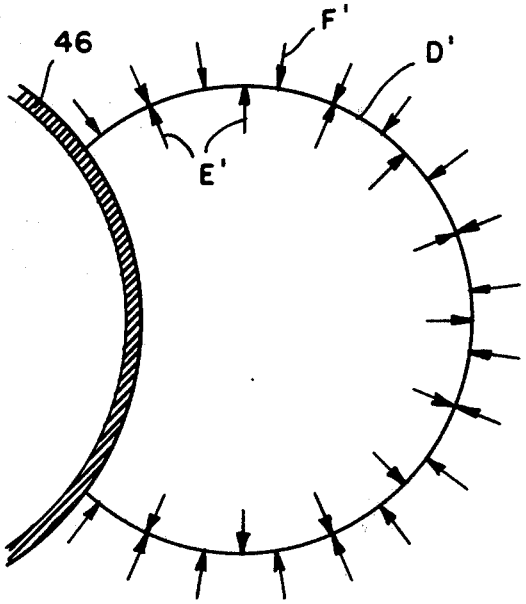
Figure 4D:
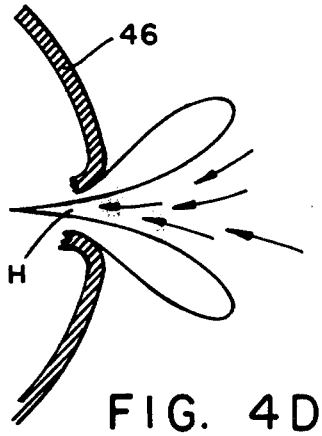

The operation of warhead unit 34 will now be described in connection with FIGS. 4A, 4B, 4C and 4D. It is assumed that the warhead is detonated a distance within several feet of a submarine hull 46, FIG. 4A, in response to an electrical firing impulse generated by fusing device 40. FIG. 4A shows the gas bubble front D shortly after release of the gases by the explosive reaction. At this stage the bubble front is progressively expanding under the excess internal pressure of gases within the bubble, symbolically indicated by arrows E, over the external hydrostatic pressure of the ambient water, arrows F. The shock wave front G precedes the bubble front. However, the gas bubble does not stop expanding when pressures E and F are equal. Instead of stopping, the kinetic energy of the water particles adjacent the gas bubble causes the gas bubble to continue expanding until the bubble front D', FIG. 4B, reaches its maximum size. At this time the bubble radius exceeds the distance to the submarine and a material portion of bubble front D' is in direct contact with the submarine hull 46. When the gas bubble is at its peak of expansion the external pressure F' exceeds the internal pressure E' causing the gas bubble to start to collapse. Although the progressive expansion of the bubble took place with spherical symmetry, the collapsing bubble front D'', FIG. 4C, is unsymmetrically with the side of the bubble front in contact with the hull remaining in contact with the hull, and the side of the bubble front diametrically opposite to the hull collapsing more rapidly than the other portions of the bubble front. This unsymmetrical mode of collapse is believed to be due to the unsymmetrical hydrodynamic force acting on the bubble as the result of a material portion of the bubble front being in contact with the target surface. Continued collapsing of the bubble front results in the formation of a re-entrant jet of ambient water H, FIG. 4D, which enters the bubble from the side of the bubble diametrically opposite to the submarine hull, and in a direction normal to the surface of the submarine hull 46. This jet contains a large proportion of the energy of the explosive reaction which was transformed into gas bubble energy, and strikes the hull 46 in a direction normal to the hull surface. The energy of jet H is concentrated over its relative small cross-sectional area and therefore exerts a large punch-like force upon the submarine hull, which is highly effective in piercing the hull, as shown. While the changes of shape of the bubble have been described as sequentially occurring conditions, it is to be understood that this phenomenon in fact occurs with explosive suddenness and the total interval of time between detonation of the warhead and formation of the re-entrant jet is in the order of a small fraction of a second.

An important feature of this invention is that a warhead unit constructed in accordance with the invention may contain a large proportion of water reactive material by weight, and therefore produce the large bubbles which are needed in order to implement formation of the punch-like re-entrant jets. Warheads containing 80% or more, by weight, of water reactive material are possible, by employing the principles of this invention. The effective and complete reaction of these large proportions of water reactive material is the result of the explosive bursting force of the high explosive being directed symmetrically outwardly from the center of the warhead. This outwardly directed bursting force causes the particles of water reactive material to penetrate the surrounding water medium with a symmetric pattern of penetration, which insures effective and complete reaction between the particles and water medium.

Obviously many modifications and variations of the present invention are possible in the light of the above teachings. It is therefore to be understood that within the scope of the appended claims the invention may be practiced otherwise than as specifically described.

What is claimed is:

1. Apparatus for inflicting explosive damage upon an underwater object, comprising;

(a) an encapsulated charge of a first material which is highly reactive with water, said first charge being for explosively reacting with the water to produce a gas bubble which sequentially expands to a predetermined peak size and then contracts, (b) explosive means for bursting the encapsulated charge in a manner in which the bursted particles of said first materials are dispersed in directions symmetrically outward from the center of the charge to cause the bursted particles of said bursted material to penetrate the ambient water with a symmetric and uniformly dense pattern of penetration, and thereby obtain effective and complete explosive reaction between said first material and the water medium and produce said peak size of bubble, and (c) means for initiating said explosive means for bursting the encapsulated charge when said charge is sufficiently close to the object that a material portion of the bubble front is in contact with the surface of the object when the bubble reaches its peak size, whereby upon contraction of the gas bubble a re-entrant jet of ambient water enters the bubble in a direction normal to the surface of the object to exert a punch-like force thereagainst.

* * * * *